US006123793A

United States Patent [19]

Hung

[11] Patent Number: 6,123,793

[45] Date of Patent: Sep. 26, 2000

[54] METHOD FOR MANUFACTURING PALLETS

[76] Inventor: Chih-Shiu Hung, No. 309-9, Syh-Der Road, Wu Feng Hsiang, Taichung Hsien, Taiwan

[21] Appl. No.: 09/210,652

[22] Filed: Dec. 14, 1998

[51] Int. Cl.[7] ..... B31D 3/02; B32B 3/06; B32B 3/12

[52] U.S. Cl. ..... 156/182; 156/197; 156/256; 156/258; 156/266; 156/269; 156/291; 156/293

[58] Field of Search ..... 156/197, 182, 156/290, 292, 293, 257, 291, 256, 266, 250, 269, 512, 516, 517, 519, 263, 258; 108/53.1, 57.1; 428/116, 118

[56] References Cited

U.S. PATENT DOCUMENTS 3,810,798 5/1974 McCoy ..... 156/62.2
5,326,615 7/1994 Tsuchihashi et al. ..... 428/116
5,667,620 9/1997 Grigsby et al. ..... 156/182

*Primary Examiner*—Michael W. Ball
*Assistant Examiner*—Barbara Musser
*Attorney, Agent, or Firm*—Charles E. Baxley, Esq.

[57] ABSTRACT

A method uses waste paper materials to manufacture the pallets having a solid structure. A number of paper sheets are superposed with each other and adhered together at a number of adhering portions arranged in an alternation way, and cut to form an upper prototype having two or more legs, and expanded to a honeycomb structure. A lower prototype is also formed by the paper sheets and cut to form two or more protrusions and expanded to a honeycomb structure. The protrusions of the lower prototype are engaged into the legs of the upper prototype and engaging with the legs for allowing the honeycomb prototypes to be solidly secured together with a greatly increased adhering area. A cover sheet and a base sheet are preferably attached to the upper and the lower surfaces of the honeycomb prototypes.

7 Claims, 5 Drawing Sheets

METHOD FOR MANUFACTURING PALLETS

BACKGROUND OF THE INVENTION

1. Field of the Invention

The present invention relates to a method, and more particularly to a method for manufacturing pallets.

2. Description of the Prior Art

Typical pallets are made of paper materials and comprise a honeycomb structure having a body and two or more legs secured to the body by such as adhering materials. However, the legs of the typical paper pallets have a small size to be adhered to the body, such that the legs may be easily disengaged from the body after being moved by fork lift machines.

The present invention has arisen to mitigate and/or obviate the afore-described disadvantages of the conventional pallets.

SUMMARY OF THE INVENTION

The primary objective of the present invention is to provide a method for manufacturing pallets having a solid configuration.

In accordance with one aspect of the invention, there is provided a method for manufacturing pallets, the method comprising superposing a plurality of paper sheets together and adhering the paper sheets together at adhering portions that are arranged in an alternation way for forming a paper block, cutting the paper block to form a first prototype having at least two legs extended therefrom for defining at least one recess therebetween, expanding the first prototype to a first honeycomb prototype member, the first honeycomb prototype member including a first surface and a second surface, cutting the paper block to form a second prototype having at least two protrusions extended therefrom for defining at least one cavity therebetween, expanding the second prototype to a second honeycomb prototype member, the second honeycomb prototype member including a first surface and a second surface, engaging the at least two protrusions of the second prototype into the at least one recess of the first prototype and engaging with the at least two legs of the first prototype, and adhering the at least two protrusions of the second prototype and the at least two legs of the first prototype together to form the pallet.

A cover sheet is attached to the first surface of the honeycomb prototype members, and a base sheet is attached to the second surface of the first honeycomb prototype member.

The first and the second honeycomb prototype members are preferably depressed before the cover sheets and/or the base sheets are attached thereto.

The base sheets are preferably depressed to form a plurality of depressed lines therein before the base sheets are attached to the second surfaces of the honeycomb prototype member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
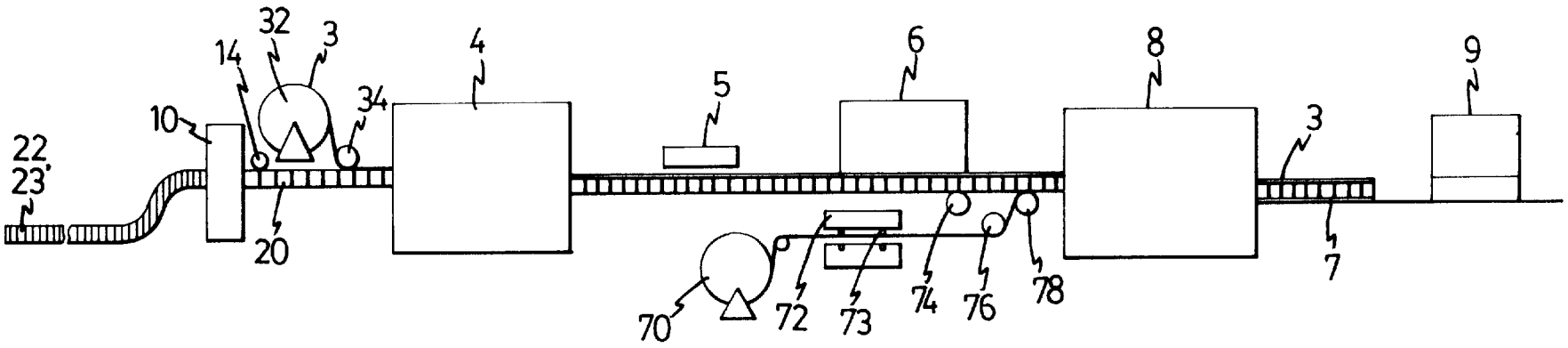
FIG. 1 is a schematic view illustrating the facility for conducting a method in accordance with the present invention that is provided for manufacturing pallets.
Figure 3:
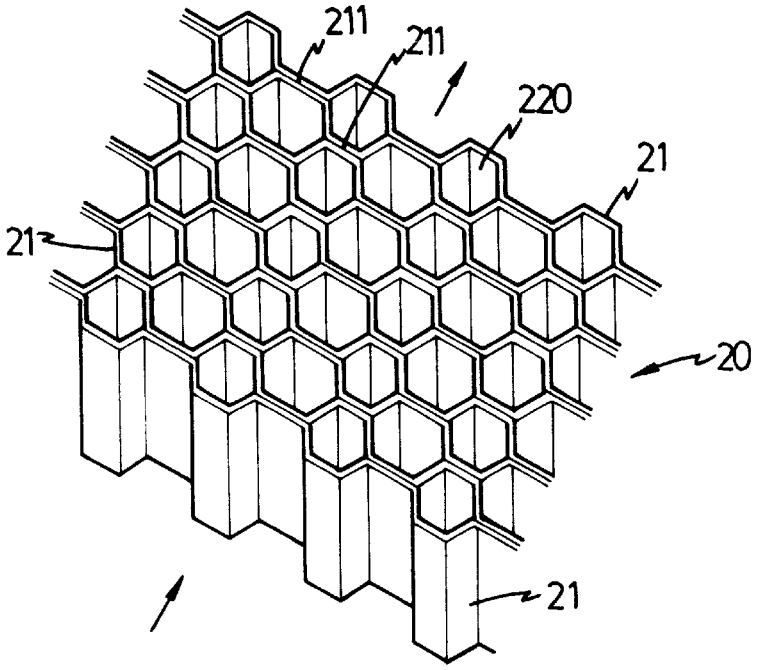
FIG. 3 is a partial perspective view illustrating the material for making the pallets after being expanded.
Figure 2:
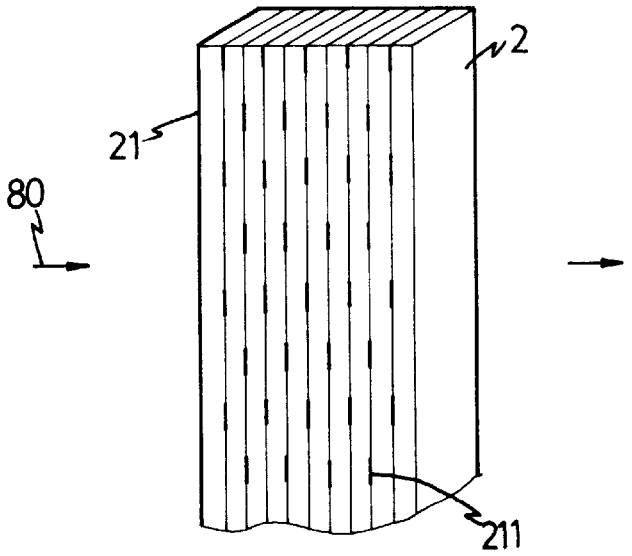
FIG. 2 is a partial perspective view illustrating the material for making the pallets.

Referring to the drawings, and initially to FIG. 1, illustrated is a facility for conducting a method in accordance with the present invention. Before discussing the facility, please refer to FIGS. 2 and 3, a number of paper sheets 21 are superposed together and are adhered together at adhering portions 211 that are arranged in an alternation way for forming a paper block 2 (FIG. 2). The paper block 2 has one end to be gradually pulled away from the paper block 2 for forming a honeycomb member 20 (FIG. 3) and for forming a number of openings 220 between the paper sheets 21.

The paper block 2 is first cut along the direction as shown by an arrow 80 in FIG. 2, before the paper block 2 is expanded, so as to form a prototype 22 that includes a flat upper surface and that includes two or more legs 221 extended downward therefrom for defining one or more recesses 28 between the legs 221. Another paper block 2 is also cut along the direction as shown by an arrow 80 in FIG. 2, before the paper block 2 is expanded, so as to form another prototype 23 that includes a flat bottom surface and that includes two or more protrusions 231 extended upward therefrom for defining one or more cavities 230 between the protrusions 231. The protrusions 231 of the prototype 23 are to be engaged into the recess 28 of the other prototype 22 and to be engaged with the legs 221 of the prototype 22, such that the prototypes 22, 23 may be solidly secured together with a greatly increased contact and adhering area. The cavities 230 of the prototype 23 are provided for receiving the forks of the fork lift machines. The pallet may include a single cavity 230 of an increase width that is good enough for receiving the forks. However, it is preferable that the pallets each includes two or more cavities 230 formed in the prototype 23 for receiving and for engaging with the forks of the fork lift machine.

Referring again to FIGS. 1 and 4, 5, the facility includes an expanding station 10 for expanding the prototypes 22, 23 into the honeycomb prototype member 20 (22, 23) and preferably includes a wheel or a roller 14 for pressing the upper surface of the honeycomb prototype member 20 (22, 23) and for slightly deforming the upper surface and for increasing the paper materials in the upper surface of the honeycomb prototype member 20 (22, 23). A reel of cover sheet 3 is engaged on a Spool 32 and may be unwound from the spool 32 and may be pressed onto the upper surface of the honeycomb prototype member 20 (22, 23) by a roller 34. An adhesive material may be applied onto the upper surface of the honeycomb prototype member 20 (22, 23) and/or applied onto the lower surface of the cover sheet 3 manually or by the roller 14 before the cover sheet 3 is pressed onto the honeycomb prototype member 20 (22, 23). The honeycomb prototype member 20 (22, 23) and the cover sheet 3 that are adhered together are moved into and moved through a drying station 4 which includes a heater, for example, for drying the adhesive material and for solidly securing the honeycomb prototype member 20 (22, 23) and the cover sheet 3 together which may then be trimmed by a trimming mechanism 5 and may be cut, at such as a cutter station 6, into a number of elements that have no base sheet 7 attached thereto yet. The cutter station 6 may be eliminated.

Figure 4:
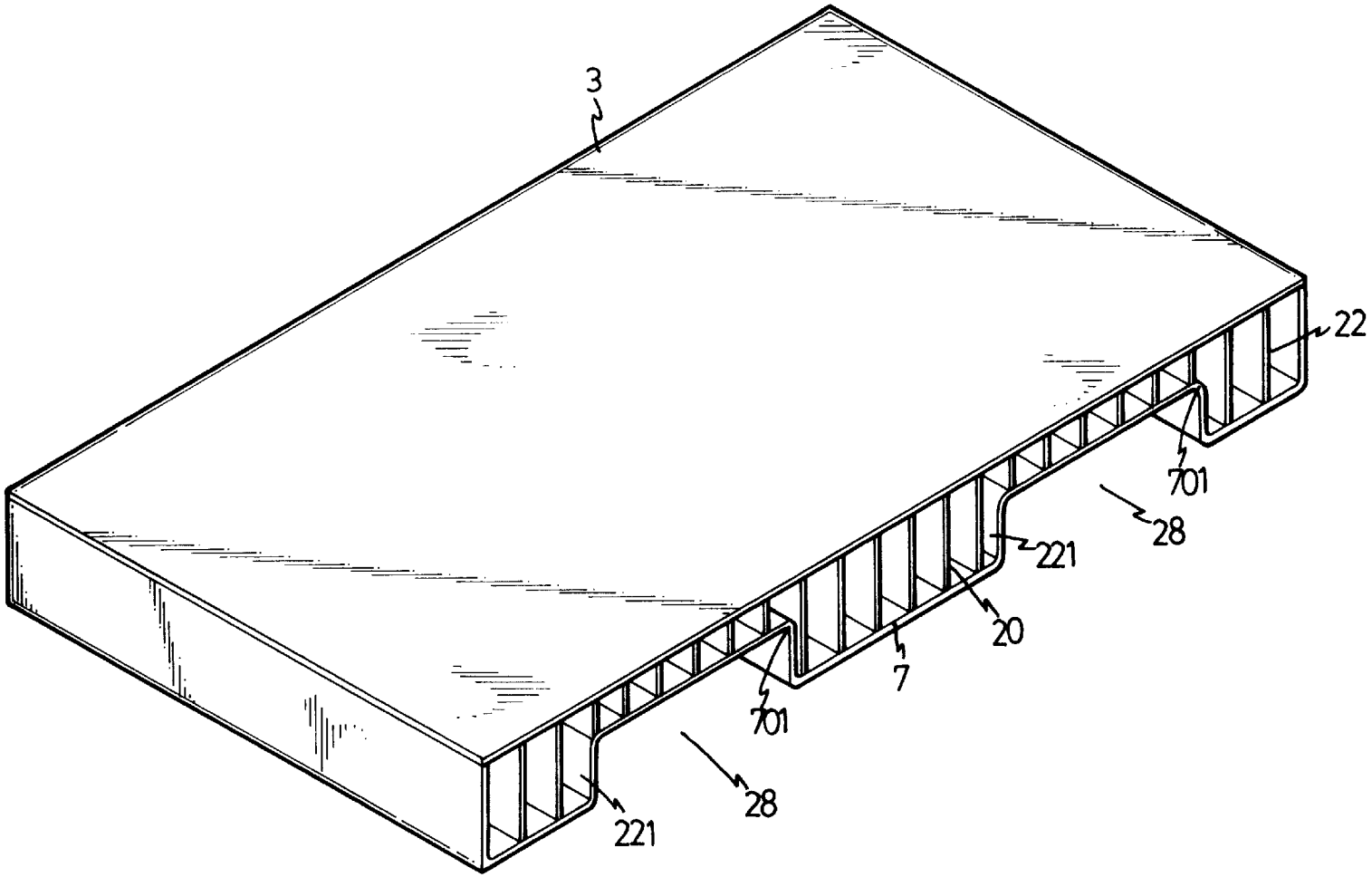
FIGS. 4 and 5 are perspective views illustrating the two portions for forming a pallet.
Figure 5:
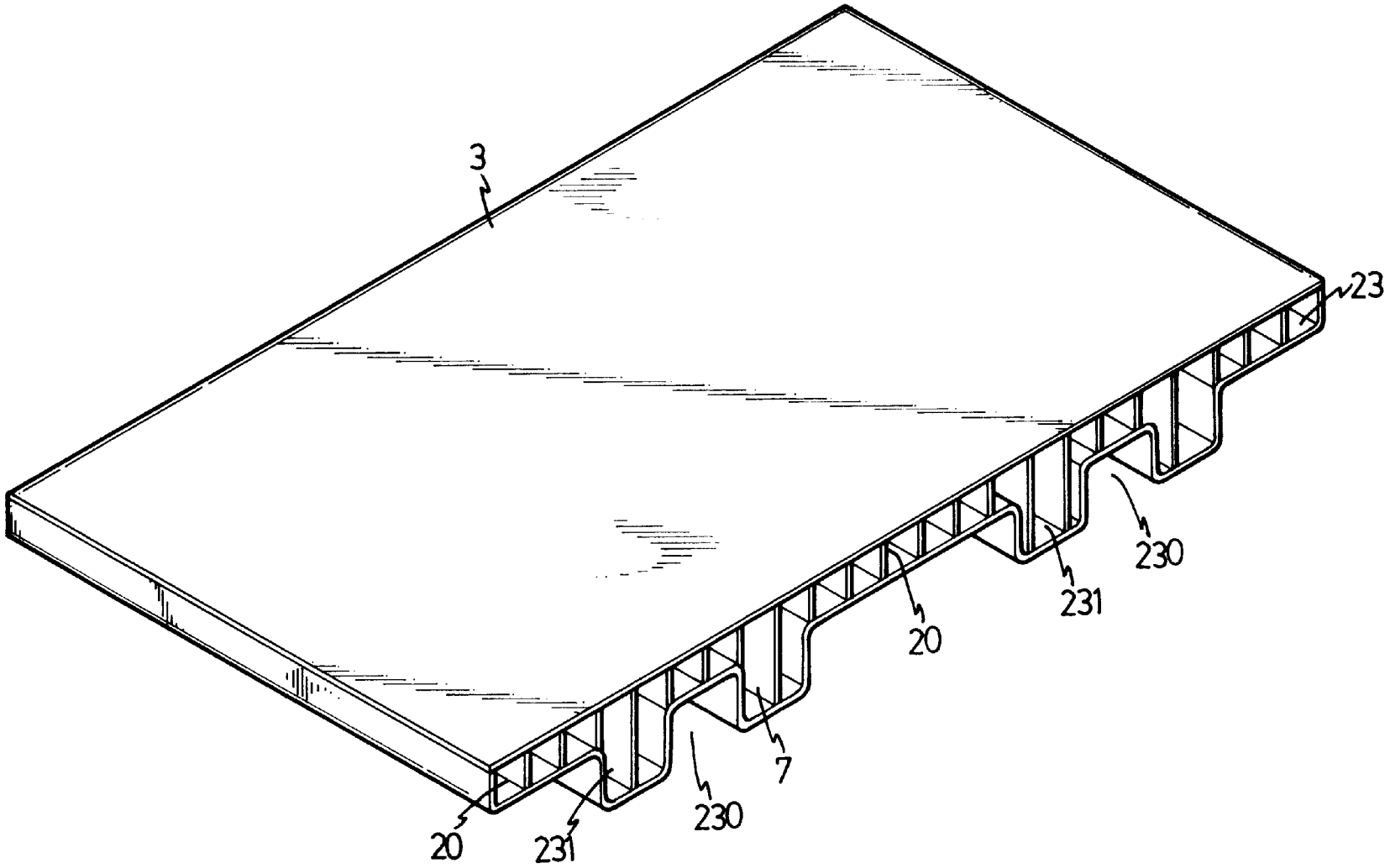

The facility preferably includes a wheel or a roller 74 for pressing the bottom surface of the honeycomb prototype member 20 (22, 23) and/or of the elements and for slightly deforming the bottom surface and for increasing the paper materials in the bottom surface of the honeycomb prototype member 20 (22, 23). A reel of base sheet 7 is engaged on a spool 70 and may be unwound from the spool 70. An adhesive material may be applied onto the bottom surface of the honeycomb prototype member 20 (22, 23) and/or applied onto the upper surface of the base sheet 7 manually or by the roller 74 before the base sheet 7 is pressed onto the honeycomb prototype member 20 (22, 23). It is preferable that, before being applied with the adhesive materials, the base sheet 7 is formed with a number of depressed lines 710 (FIG. 4) with a mold device 72 having one or more projections 73 for forming the lines 710 and for allowing the base sheet 7 to be attached and adhered onto the bottom surfaces of the honeycomb prototype member 20 (22, 23). The base sheet 7 may then be pressed onto the bottom surface of the honeycomb prototype member 20 (22, 23) by one or more rollers 76, 78, for allowing the base sheet 7 to be solidly attached to the honeycomb prototype member 20 (22, 23). The honeycomb prototype member 20 (22, 23) and the base sheet 7 that are adhered together are moved into and moved through another drying station 8 which includes a heater, for example, for drying the adhesive material and for solidly securing the honeycomb prototype member 20 (22, 23) and the base sheet 7 together which may then be cut, at another cutter station 9, into a number of prototypes 22, 23 having the honeycomb structure formed therein, as shown in FIGS. 4 and 5.

Figure 6:
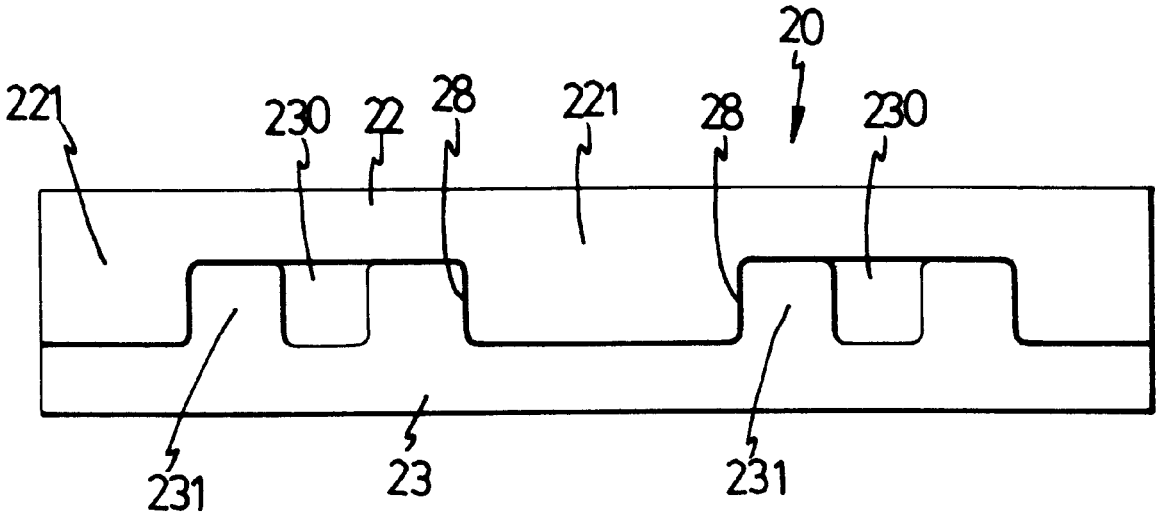
FIG. 6 is a side view of a pallet manufactured by the method in accordance with the present invention.

The protrusions 231 of the prototype 23 are then engaged into the recess 28 of the other prototype 22 and engaged with the legs 221 of the prototype 22, such that the prototypes 22, 23 may be solidly secured together with a greatly increased contact and adhering area (FIG. 6) and such that the prototypes 22, 23 will not be easily disengaged from each other. The prototypes 22, 23 are manufactured separately by the facility as shown in FIG. 1 before the prototypes 22, 23 are adhered together. The paper sheets 21 and the cover sheet 3 and the base sheet 7 are preferably recovered from the waste materials, particularly the waste paper materials. The base sheet 7 may also be attached onto the prototypes 22, 23 before the cover sheet 3 is attached onto the prototypes 22, 23.

Accordingly, the method in accordance with the present invention may be used for manufacturing pallets having a solid configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for manufacturing pallets, said method comprising:

superposing a plurality of paper sheets together and adhering said paper sheets together at adhering portions that are arranged in an alternation way for forming a paper block, cutting said paper block to form a first prototype having at least two legs extended therefrom for defining at least one recess therebetween, expanding said first prototype to a first honeycomb prototype member, said first honeycomb prototype member including a first surface and a second surface, cutting said paper block to form a second prototype having at least two protrusions extended therefrom for defining at least one cavity therebetween, expanding said second prototype to a second honeycomb prototype member, said second honeycomb prototype member including a first surface and a second surface, engaging said at least two protrusions of said second prototype into said at least one recess of said first prototype and engaging with said at least two legs of said first prototype, and adhering said at least two protrusions of said second prototype and said at least two legs of said first prototype together to form said pallet.

2. The method as claimed in claim 1 further comprising attaching a cover sheet to said first surface of said first honeycomb prototype member, attaching a base sheet to said second surface of said first honeycomb prototype member, attaching a cover sheet to said first surface of said second honeycomb prototype member, and attaching a base sheet to said second surface of said second honeycomb prototype member.

3. The method as claimed in claim 2 further comprising pressing said first honeycomb prototype member before attaching said cover sheet to said first surface of said first honeycomb prototype member.

4. The method as claimed in claim 2 further comprising pressing said first honeycomb prototype member before attaching said base sheet to said second surface of said first honeycomb prototype member.

5. The method as claimed in claim 2 further comprising pressing said second honeycomb prototype member before attaching said cover sheet to said first surface of said second honeycomb prototype member.

6. The method as claimed in claim 2 further comprising depressing said base sheet to form a plurality of depressed lines in said base sheet before said base sheet is attached to said second surface of said first and said second honeycomb prototype members.

7. The method as claimed in claim 2 further comprising pressing said second honeycomb prototype member before attaching said base sheet to said second surface of said second honeycomb prototype member.

* * * * *